US006676257B2

(12) United States Patent
Sheldon et al.

(10) Patent No.: US 6,676,257 B2
(45) Date of Patent: Jan. 13, 2004

(54) EYEWEAR WITH POLARIZED LENS FOR WATER SPORTS

(76) Inventors: Brent Sheldon, 72 Sherbrooke Street West, Apt. 3, Montreal, Quebec (CA), H2X 1X3; Neville C. Sheldon, 315 Putney Street, St. Lambert, Quebec (CA), J4P 3B5

( * ) Notice: Subject to any disclaimer, the term of this patent is extended or adjusted under 35 U.S.C. 154(b) by 0 days.

(21) Appl. No.: 10/167,660

(22) Filed: Jun. 13, 2002

(65) Prior Publication Data

US 2002/0191148 A1 Dec. 19, 2002

Related U.S. Application Data

(60) Provisional application No. 60/298,400, filed on Jun. 18, 2001.

(51) Int. Cl.[7] ..... G02C 7/12
(52) U.S. Cl. ..... 351/49; 351/43; 351/62
(58) Field of Search ..... 351/41, 43, 44, 351/49, 62

(56) References Cited

U.S. PATENT DOCUMENTS 4,261,656 A * 4/1981 Wu ..... 351/163
4,648,925 A 3/1987 Goepfert et al.
4,838,673 A 6/1989 Richards et al.
4,989,274 A * 2/1991 Patelski, III ..... 2/436
5,191,363 A 3/1993 Smith et al.
5,327,180 A 7/1994 Hester, III et al.
5,355,183 A 10/1994 Andrea
5,363,151 A * 11/1994 Biays et al. ..... 351/43
5,526,068 A 6/1996 Markovitz
5,663,779 A 9/1997 Karasawa
6,089,643 A 7/2000 Wang et al.
2001/0028435 A1 * 10/2001 Evans et al. ..... 351/163

* cited by examiner

*Primary Examiner*—Huy Mai
(74) *Attorney, Agent, or Firm*—Ogilvy Renault; Wayne H. Yan

(57) ABSTRACT

Swimming goggles or diving masks having a polarized lens of the present invention include a sealed polarized lens unit. The sealed polarized lens unit has a seal member covering and extending beyond the peripheral edge of the laminated polarized lens to protect the polarized lens from de-lamination resulting from encroaching moisture. A non-polarized lens may be optionally affixed in the frame to provide additional protection of the polarized lens, from water impact. Swimming goggles or diving masks having polarized lenses provide a glare-eliminating feature which is particularly useful for water sports where glare significantly inhibits participant vision.

11 Claims, 4 Drawing Sheets

EYEWEAR WITH POLARIZED LENS FOR WATER SPORTS

CROSS-REFERENCE TO RELATED APPLICATIONS

This application is based on and claims benefit under 35 U.S.C.119(e) of U.S. Provisional Patent application No. 60/298,400, filed on Jun. 18, 2001.

TECHNICAL FIELD

The present invention relates to protective lenses, particularly to eyewear with polarized lens, and is more especially directed to eyewear with polarized lens for water sports, such as swimming goggles, diving masks and the like.

BACKGROUND OF THE INVENTION

Polarization is one of the fundamental properties of light waves. Generally, in an unpolarized wave, the vibration in a plane perpendicular to the ray appears to be oriented in all directions with equal probability. In a polarized wave the displacement direction of the vibrations is completely predictable. When light is reflected from a surface, it is partially polarized. When it is reflected at a particular angle, for example 53° in the case of water, it is completely polarized. Such polarized light produces undesirable effects which are an increase in brightness and a reduction in colour saturation such that glare occurs. This makes objects viewed in the presence of glare appear to be washed-out and causes eye strain and discomfort. Tinted glasses or plastic lenses cannot solve the problem of glare. Such glare is particularly acute when reflected from water surfaces, the surface of snow, shiny vehicle hoods or roadways, and is generally polarized in a plane parallel to the reflecting surface.

A major advantage of eye glasses having polarized lenses is the ability to reduce glare from light striking reflective surfaces. When such polarized glare is viewed through a polarizer, the glare is completely eliminated. Polarized sun glasses reduce glare by having a vertical transmission axis, but blocking the dominantly horizontally polarized reflected light from horizontal surfaces.

It is well known to make sun glasses having polarized lenses. U.S. Pat. No. 4,838,673, issued to Richards et al. on Jun. 13, 1989, describes a sunglass lens which includes two layers of ground and polished mineral glass laminated together with a polarized film between the two glass layers to form a single lens having an inner and an outer surface. An anti-reflectent coating is attached to the inner surface of the lens and a bigradient coating is attached to the outer surface of the lens. U.S. Pat. No. 5,327,180, issued to Hester, III et al., on Jul. 5, 1994, as another example of sunglasses having polarized lenses, describes a polarized lens and a pair of glasses incorporating the lens. Similar to the lens described by Richards et al., the lens described by Hester, III et al. includes two lens elements, preferably formed of mineral glass, laminated together with a polarization film therebetween. The laminated lens is also applied with anti-reflectent coating and additionally with waterproof coatings.

It is also known that a light polarizing visor can be incorporated into a glare shielding board to be pivotally secured adjacent to the rearview mirror of a vehicle, as described in U.S. Pat. No. 6,089,643, issued to Wang et al. on Jul. 18, 2000.

The reduction in glare by polarized lenses can be dramatic. Nevertheless, this is not fully recognized and appreciated by many members of the public who purchase sunglasses and who often are more concerned with the tint and general reduction of light provided by sunglasses rather than selective reduction of polarized light. Moreover, the importance of wearing swimming goggles or diving masks with polarized lenses has not been fully recognized even through it is well known that the polarized lenses are particularly effective around water. Polarized glare reflected from the water surface inhibits the water sport participant who is positioned on the ground for jumping or diving, from viewing under the surface of the water. This can be dangerous to the participant.

Generally, sunglasses cannot replace swimming goggles or diving masks because sunglasses cannot provide the eye protection offered by swimming goggles or diving masks, with the exception of light shielding. Polarized lenses available in the marketplace are thinner than normal lenses used for swimming goggles and diving masks, and cannot sustain water pressure and water impact forces related to water sports, especially when the wearer is jumping or diving into the water.

Another problem regarding polarized lenses used for water sport eyewear is delamination caused by moisture contacting the peripheral edge of the laminated polarized lens. The laminated polarized lenses are vulnerable to moisture encroaching from the peripheral edge thereof. Hester III et al. provide additional waterproof coatings to the laminated lens of sunglasses. However, the waterproof coatings do not protect the peripheral edge of the laminated polarized lens from contacting moisture. In prior art, lenses are affixed in frames of swimming goggles or diving masks, usually in a relatively water-tight manner to prevent significant water leakage into the goggles or masks when the goggles or masks are worn on the head of a wearer and a gasket around the frame is pressed against the wearer's face. Nevertheless, this type of water-tight manner does not ensure that moisture is prevented from contacting the peripheral edge of the lens, encroaching from either side of the lens. It is common for a wearer to remove the swimming goggles or diving mask from his/her head and put same into water to wash off moisture condensation collected on the inner side of the lens. It is also noted that in prior art, lenses are received directly in frames, the sealing properties of which normally rely on the elastic deformation of the frames. As a result, the sealing properties provided by the frame around lenses are not adequate with respect to the requirement of preventing moisture from contacting the peripheral edge of the lenses, because the frame material must be rigid or semi-rigid in order to maintain its shape, which compromises its elastic properties and therefore adversely affects the sealing result.

The Applicant is aware of no swimming goggles or diving masks with polarized lenses currently available in the marketplace, nor is the Applicant aware of public documentation providing technical description of swimming goggles or diving masks with polarized lenses. U.S. Pat. No. 5,191,363, issued to Smith et al. on Mar. 2, 1993, describes sports glasses with a water-tight seal and merely mentions a lens, preferably polarized. Smith et al. neither address the particular sealing requirement of the peripheral edge of the polarized lenses, nor provide technical teachings for such a seal. Therefore, there is a need for swimming goggles and diving masks with polarized lenses which overcome the above mentioned problems.

SUMMARY OF THE INVENTION

It is one object of the present invention to provide swimming goggles or diving mask with polarized lenses.

In accordance with one aspect of the present invention eyewear is provided for water sports. The eyewear comprises at least one laminated polarized lens having means surrounding and sealing a peripheral edge thereof, for preventing moisture from contacting the peripheral edge of the laminated polarized lens. The lens and means forms a sealed lens unit. A frame is provided to receive the sealed lens unit affixed therein. Retaining means are attached to the frame for holding the eyewear against the face of a wearer thereof.

The eyewear used for water sports according to the present invention, in particular swimming goggles or a diving mask, preferably has the laminated polarized lens protected from water impact by a non-polarized lens.

The means surrounding and sealing the peripheral edge of the laminated polarized lens preferably comprise an elastomeric and water-impermeable ring in tension, covering and extending beyond the peripheral edge thereof; or preferably comprise a water-impermeable sealing film covering and extending beyond the peripheral edge of the laminated polarized lens in a water-tight manner.

In one embodiment of the present invention, the non-polarized lens is a conventional lens of swimming goggles or a diving mask. The sealed lens unit containing the laminated polarized lens with the seal ring as a single piece, for example, is glued to the inside of the swimming goggles or diving mask. Thus, the conventional lens that is positioned on the outer side of the sealed lens unit protects the polarized lens from water impact and the seal members, such as the elastomeric ring of the sealed lens unit protect the peripheral edge of the laminated polarized lens from contacting moisture even when the swimming goggles or diving mask are off the wearer's head and are immersed in water.

In another embodiment of the present invention, the laminated polarized lens is laminated together with the non-polarized lens. A seal member, preferably the elastomeric ring, covers and extends beyond the peripheral edge formed by both the laminated polarized lens and the non-polarized lens in a water-tight manner, in order to prevent moisture from contacting the peripheral edge. The seal member secures the laminated polarized lens and the non-polarized lens together to form the sealed lens unit. The sealed lens unit containing the polarized lens is affixed in the frame of the swimming goggles or diving mask. The laminated polarized lens which constitutes layers of the sealed lens unit positioned in the swimming goggles or diving mask to be closest to the wearer's face while in use, is protected by the non-polarized lens which constitutes the outer lens surface when positioned in the swimming goggles or diving mask while in use. The non-polarized lens is preferably made of polycarbonate plastic.

The glare eliminating feature of the swimming goggles or diving mask having polarized lenses according to the present invention is particularly useful for water sports where glare significantly inhibits participant vision. The swimming goggles or diving mask of the present invention provide the wearer with better vision through the water surface before the wearer jumps or dives into the water, to improve the safety of the water sport participant.

Other advantages and features of the present invention will be better understood with reference to preferred embodiments of the present invention described hereinafter.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENT

Figure 1:
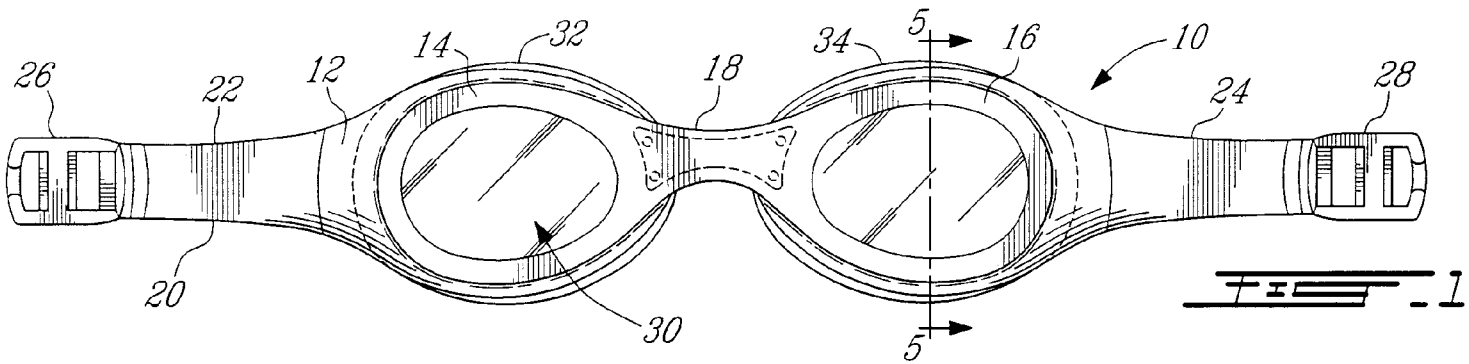
FIG. 1 is a front view of swimming goggles having polarized lenses according to the present invention.

With reference to the drawings and in particular to FIG. 1, a pair of swimming goggles having polarized lenses according to the present invention, generally designated with reference numeral 10, is shown. The pair of swimming goggles 10 comprises a frame structure 12 with two frame sections 14, 16 and a bridge 18 connected between an inner side of the frame sections 14, 16 of the frame 12. A head strap 20 including sections 22, 24 is affixed to an outer side of the respective frame sections 14, 16 to be connected to each other by means of fasteners 26, 28 which are attached to the free end of the strap sections 22, 24, respectively. Each of the frame sections 14, 16 of the frame 12 has a sealed polarized lens unit 30 affixed therein and a gasket 32 or 34 extending along the lens section of the frame 12.

Figure 2:
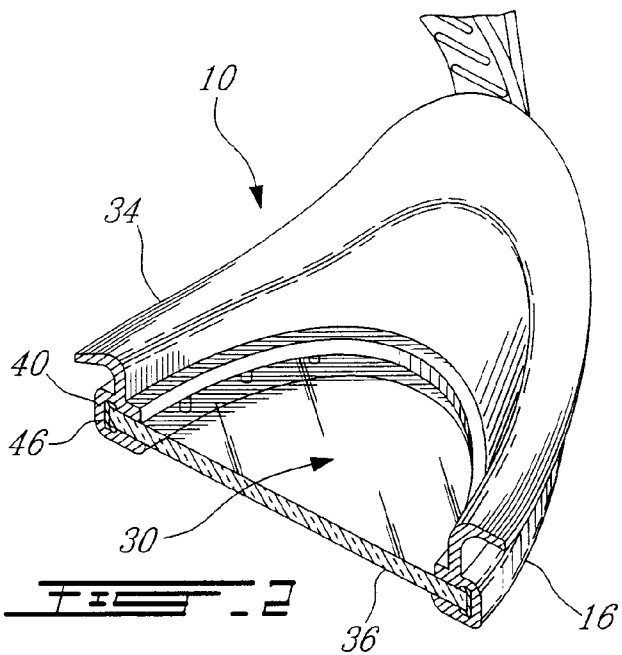
FIG. 2 is a perspective view of a portion of the swimming goggles cut along line 5—5 of FIG. 1 and showing a lens structure thereof according to one embodiment of the present invention.
Figure 5A:
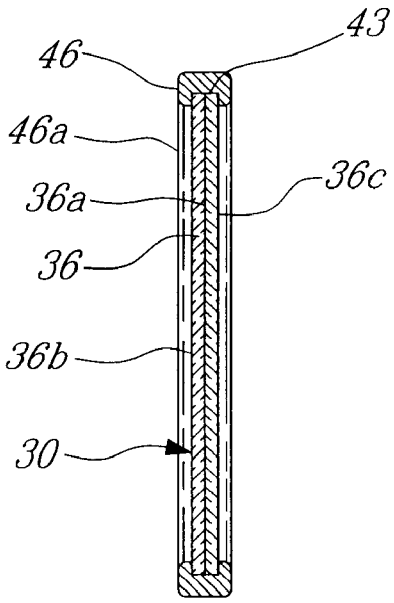
FIGS. 5*a*–5*b* are cross-sectional views of the swimming goggles taken along line 5—5 of FIG. 1, showing details of a sealed lens unit according to various embodiments of the present invention, and being used with the lens structures shown in FIGS. 2 and 4.

Reference will now be made to FIGS. 2 and 5*a*. The sealed polarized lens unit 30 includes a polarized lens 36 and a seal member 46 surrounding a peripheral edge of the polarized lens 36. The polarized lens 36 must be a laminated multi-layer lens because the polarized lens 36 generally includes a polarized filter film 36*a* sandwiched between two layers 36*b* and 36*c* of glass or any transparent plastic such as polycarbonate or acetate.

Laminated polarized lenses and a method of making same are well known in the industry, examples of which are described in U.S. Pat. Nos. 4,838,673 and 5,327,180, the specifications of which are incorporated herein by reference. There now exist in the market place, laminated polarized lenses 36 having the polarization filter film 36*a* laminated between layers 36*b* and 36*c* of acetate plastic, polycarbonate plastic or glass, or a combination of those materials. Generally, any kind of laminated polarized lenses 36 can be used in the sealed polarized lens unit 30, for the swimming goggles 10 when the laminated polarized lenses 36 are adapted to resist water impact related to water sports.

However, delamination may occur, beginning at the peripheral edge of the laminated polarized lens 36 when moisture contacts the peripheral edge thereof and encroaches therefrom. Therefore, the seal member 46 is provided to seal the peripheral edge of the laminated polarized lens 36, thereby preventing moisture from contacting the peripheral edge thereof.

In accordance with one embodiment of the present invention, the seal member 46 is an elastomeric and water-impermeable ring 46*a*, as more clearly shown in FIG. 5*a*. The ring 46*a* includes an annular groove 43 on an inner periphery, for receiving the peripheral edge of the laminated polarized lens 36 therein. The elastomeric ring 46*a* is mounted in tension around the laminated polarized lens 36, thereby covering and extending beyond the peripheral edge thereof, in order to achieve a water-tight sealing of the edge. The combination of the laminated polarized lens 36 and the elastomeric and water-impermeable ring 46*a* forms the sealed polarized lens unit 30.

It is optional to apply a liquid or semi-liquid adhesive between the peripheral edge of the laminated polarized lens 36 and the ring 46*a* to further assure the sealing result.

The sealed polarized lens unit 30, as an integral single piece, is affixed in the frame section 14 or 16 (only frame section 16 is shown) in a manner well known in the industry. For example, the ring 46*a* that surrounds the periphery of the laminated polarized lens 36 is snugly received within a continuous groove 40 in each frame section 14 or 16.

Figure 5B:
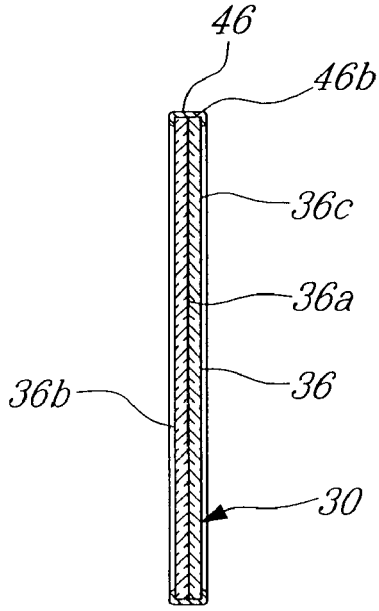

Referring to FIGS. 2 and 5*b*, the seal member 46 according to another embodiment, is a water-impermeable sealing film 46*b* which is exaggerated in FIG. 5*b* for better illustration. The sealing film 46*b* covers and extends beyond the peripheral edge of the laminated polarized lens 36 in a water-tight manner. For example, liquid or semi-liquid masses are coated on and over the peripheral edge of the laminated polarized lens 36 and are allowed to harden to form the sealing film 46*b* before the laminated polarized lens 36 is affixed in the frame section 14 or 16. Then, the sealed lens unit 30 is affixed in each frame section 14 or 16 in a conventional manner.

It is noted that acetate polarized lenses are most cost effective and therefore widely used, in contrast to other plastic or glass polarized lenses which are more difficult to manufacture. The higher melting point of polycarbonate, for example, causes the polarization filter film to melt, resulting in a high rejection rate and requiring costly specialized equipment. Therefore, acetate polarized lenses are an economic choice and will be popularly used for eyewear until the manufacturing costs of the polycarbonate polarized lenses decreases and the use of polycarbonate polarized lenses becomes more popular, which will result from the improvement of manufacturing techniques.

However, acetate polarized lenses are very thin and are not adapted to resist water impact related to water sports when the wearer's safety is concerned. In such cases an additional lens should be included in the sealed polarized lens unit 30 to protect the thin polarized lens from breaking under water impact. Examples are described below, showing the various structures of the swimming goggles 10 having the thin laminated polarized lens 36 protected by an additional non-polarized lens.

Figure 3:
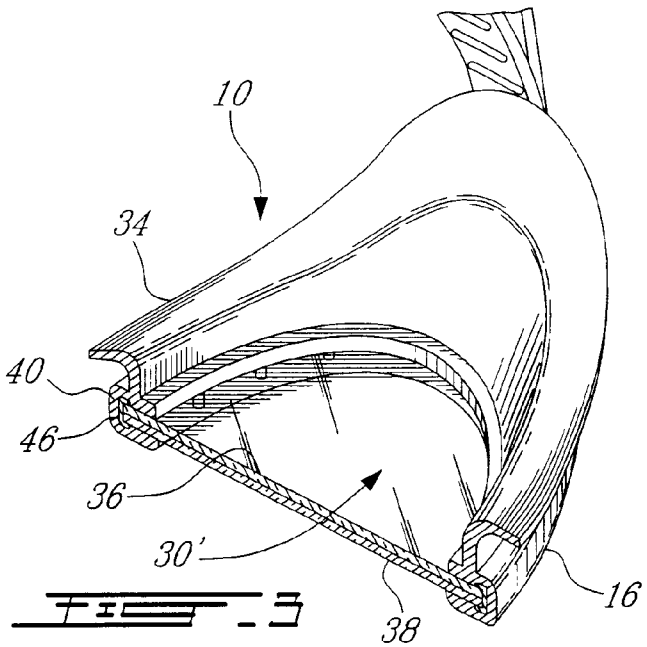
FIG. 3 is a perspective view of a portion of the swimming goggles similar to that of FIG. 2, showing the lens structure according to another embodiment of the present invention.
Figure 5C:
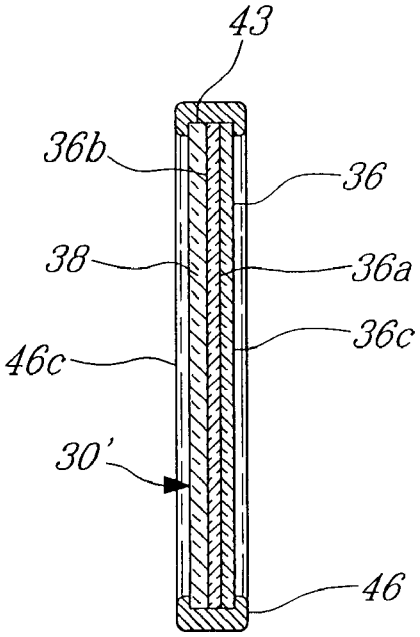
FIGS. 5*c*–5*d* are cross-sectional views of the swimming goggles also taken along line 5—5 of FIG. 1, showing details of a sealed lens unit according to further embodiments of the present invention and being used with the lens structure shown in FIG. 3.

In FIGS. 3 and 5*c*, the sealed polarized lens unit 30', according to a further embodiment includes a thin laminated polarized lens 36, for example, made of acetate plastic lenses 36*b* and 36*c* which sandwich the polarized filter film 36*a*, and a non-polarized lens 38 for example, made of polycarbonate plastic. The thin laminated polarized lens 36 is laminated to the non-polarized lens 38 to form a sole lens. The peripheral edge formed by both the laminated polarized lens 36 and the non-polarized lens 38 is received in the annular groove 43 of the elastomeric and water-impermeable ring 46*c* which forms the seal member 46 and in tension covers and extends beyond the peripheral edge thereof. Therefore, the peripheral edge formed by both the laminated polarized lens 36 and the non-polarized lens 38, is protected from contacting moisture. It is optional to apply liquid or semi-liquid adhesive between the ring 46*c* and the edge formed by both the laminated polarized lens 36 and the non-polarized lens 38 in order to assure the sealing result.

The non-polarized lens 38 constitutes an outer lens surface of the swimming goggles 10 when the sealed polarized lens unit 30' is affixed in each frame section 14 or 16 (only frame section 16 is shown). The mounting is similar to that of the sealed polarized unit 30 illustrated in FIG. 2 and will not therefore be redundantly described. Thus, the thin polarized lens 36 is protected by the relatively thicker and stronger non-polarized lens 38, from water impact.

Figure 5D:
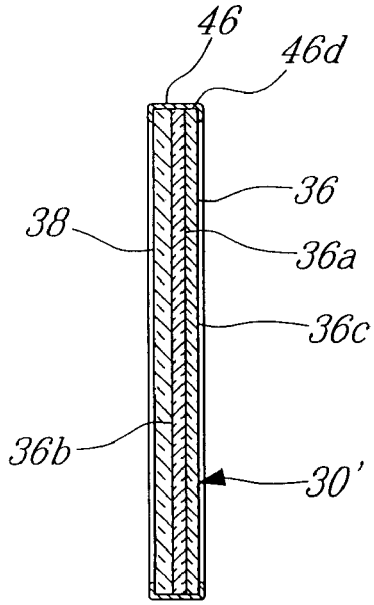

Similar to the sealing film 46*b* of the embodiment described with reference to FIGS. 2 and 5*b*, the seal member 46 of the sealed polarized lens unit 30' can also be formed by a sealing film 46*d*, as illustrated in FIG. 5*d*. The sealing film 46*d* covers and extends beyond the peripheral edge of the sole lens formed by both the laminated polarized lens 36 and the non-polarized lens 38. The sealing film 46*d* in this embodiment must have sufficient strength to secure the laminated polarized lens 36 and the non polarized lens 38 together to form the sealed polarized lens unit 30'.

Figure 4:
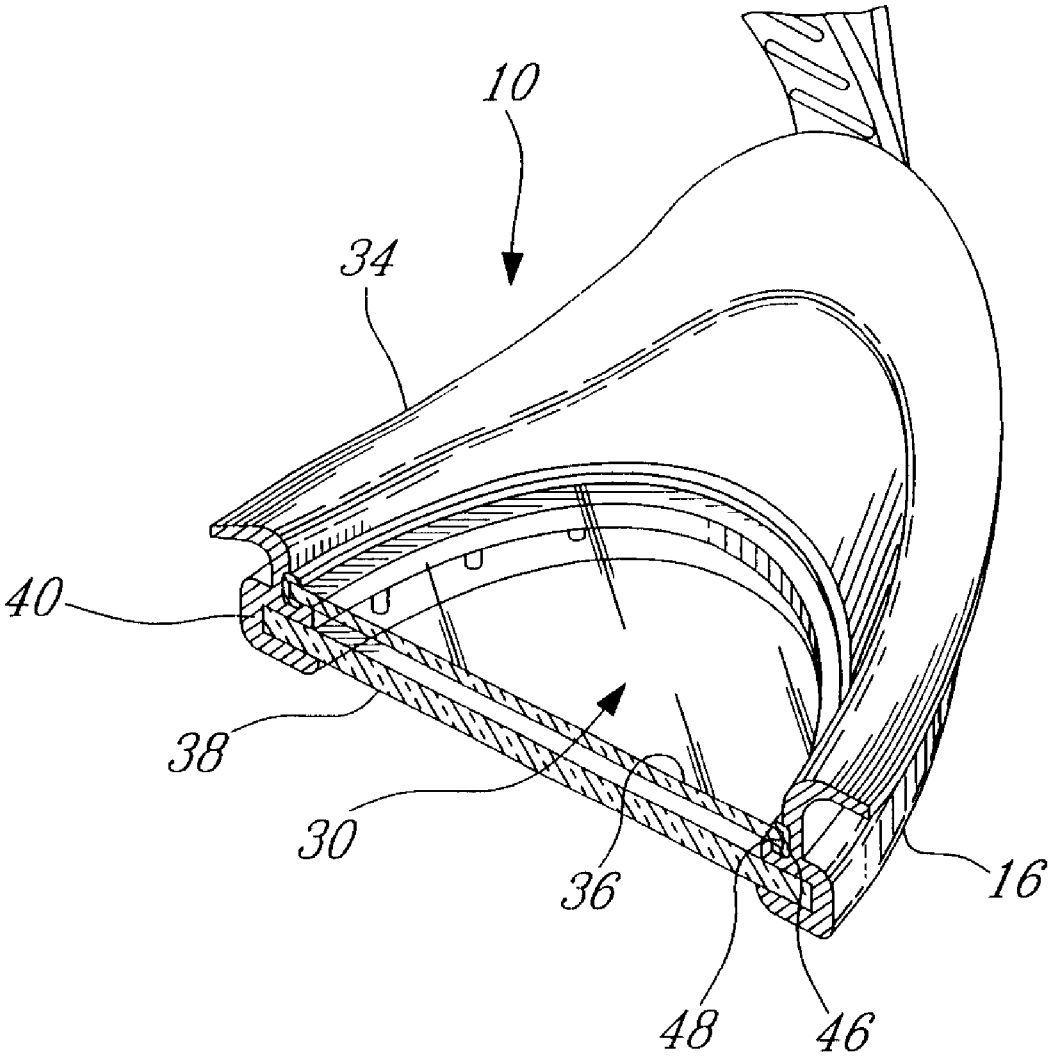
FIG. 4 is a perspective view of a portion of the swimming goggles similar to that of FIG. 2, showing the lens structure according to a further embodiment of the present invention.

In a still further embodiment of the present invention as shown in FIG. 4, the sealed polarized lens unit 30 which includes the polarized lens 36 and the seal member 46, is protected by a separate non-polarized lens 38. The non-polarized lens 38 is accommodated at its periphery within the continuous groove 40 of the frame section 14 or 16 of the frame 12 (only frame section 16 is shown), as seen in a conventional swimming goggle structure. The sealed polarized lens unit 30 is fitted within the frame section 16 and is affixed by means of glue for example, to a continuous inner shoulder 48 of the frame section 16. The space between the sealed polarized lens unit 30 and the non-polarized lens 38 may not be necessary, provided that the sealed polarized lens unit 30 can be securely attached within the frame section 16 of the frame 12. The laminated polarized lens 36 is protected by the separate non-polarized lens 38 from water impact, and protected by the seal member 46 from de-lamination resulting from encroaching moisture. This embodiment provides a simple method to convert an existing pair of swimming goggles with non-polarized lens into a pair of swimming goggles with polarized lenses.

Figure 6:
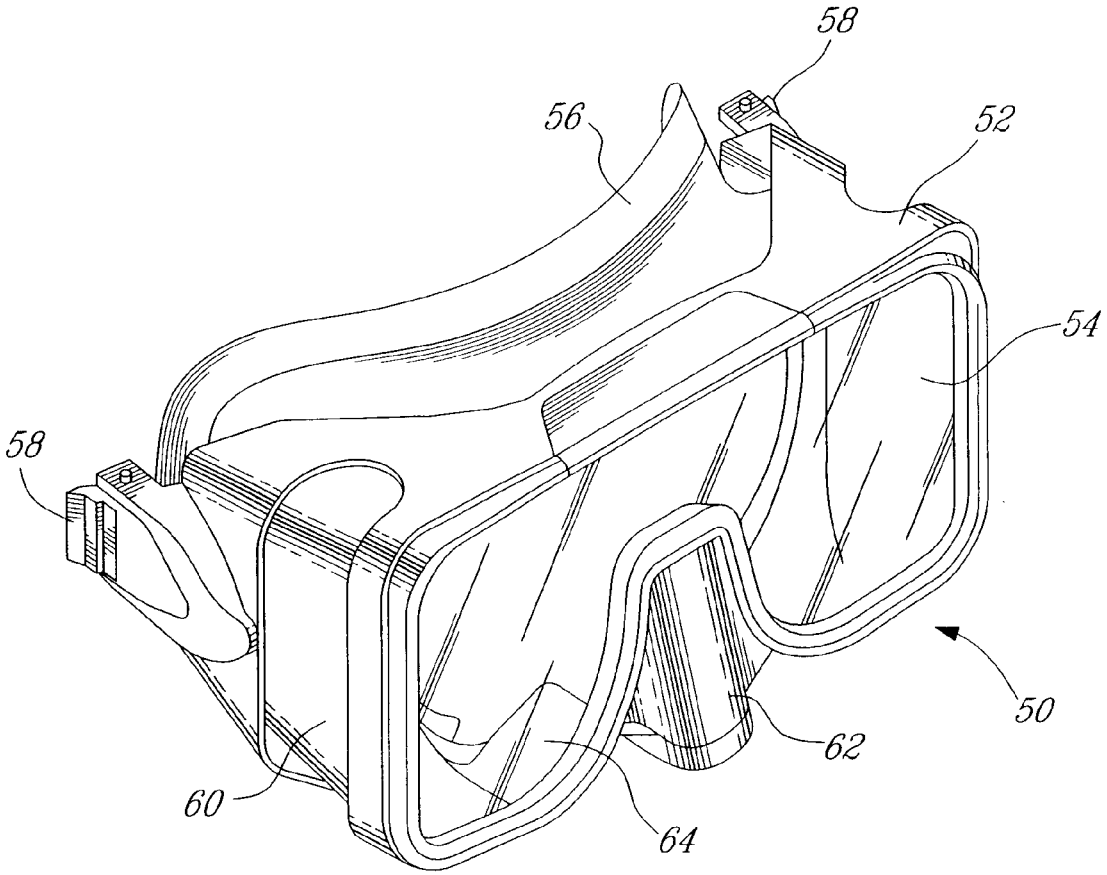
FIG. 6 is a perspective view of a diving mask having a polarized lens according to the present invention.

FIG. 6 illustrates a diving mask, as still further example of the present invention. The diving mask 50 includes a frame 52, a window containing a sealed polarized lens unit 54 and a soft skirt 56. The frame 52 provides a pair of strap receptacles 58 for receiving a strap (not shown) for securing the mask 50 to the face of a wearer.

The skirt 56 is made of flexible, soft, water-tight, rubber-like material, and is preferably transparent. The diving mask 50 may include further features which a conventional diving mask may have, such as side window lenses 60, a nose enclosure 62 and nose compression recess 64 on one side of the nose enclosure 62. Those features are well known and are described, as an example, in U.S. Pat. No. 5,860,168, issued to Winfordner et al. on Jan. 19, 1999, the specification of which is incorporated herein by reference.

The sealed polarized lens unit 54 is similar to the polarized lens units 30 and 30' shown in FIGS. 5*a*–5*d*. The various embodiments of the sealed polarized lens units 30 and 30' illustrated in FIGS. 5*a*–5*d* and various polarized lens structures used in the swimming goggles illustrated in FIGS. 1–4 are all applicable to the diving mask 50 and will not therefore be redundantly described. The non-polarized lens 38 in FIGS. 3 and 4, when used in the diving mask 50, whether integrated with or separate from the sealed polarized lens unit 54, will provide protection of the polarized lens unit 54, not only from water impact but also from water pressure.

Modifications and improvements to the above-described invention may become apparent to those skilled in the art. For example, the sealed polarized lens unit may be countersunk into the plastic swimming goggle frame or sonic weld can be used to secure the sealed polarized lens unit to the plastic swimming goggle frame. The forgoing description is intended to be exemplary rather than limiting. The scope of the invention is therefore, intended to be limited solely by the scope of the appended claims.

We claim:

1. Eyewear used for water sports comprising:

at least one laminated polarized lens having means surrounding and sealing a peripheral edge thereof for preventing moisture from contacting the peripheral edge of the laminated polarized lens, the lens and the means forming a sealed lens unit;

a frame receiving the sealed lens unit affixed therein; and retaining means attached to the frame for holding the eyewear against the face of a wearer thereof.

2. The eyewear as claimed in claim 1 wherein the means surrounding and sealing the peripheral edge of the laminated polarized lens comprise an elastomeric and water-impermeable ring in tension covering and extending beyond the peripheral edge thereof.

3. The eyewear as claimed in claim 2 wherein the elastormeric and water-impermeable ring comprises an annular groove on an inner periphery for receiving the peripheral edge of the laminated polarized lens therein.

4. The eyewear as claimed in claim 2 further comprising a liquid or semi-liquid adhesive applied between the peripheral edge of the laminated polarized lens and the elastomeric and water-impermeable ring.

5. The eyewear as claimed in claim 1 wherein the means surrounding and sealing the peripheral edge of the laminated polarized lens comprise a water-impermeable sealing film covering and extending beyond the peripheral edge of the laminated polarized lens in a water-tight manner.

6. The eyewear as claimed in claim 1 further comprising a non-polarized lens affixed in the frame on an outer side of the sealed lens unit for protecting the laminated polarized lens from water impact.

7. The eyewear as claimed in claim 2 wherein the sealed lens unit further comprises a non-polarized lens laminated with the laminated polarized lens, the elastomeric and water-impermeable ring in tension covering and extending beyond a peripheral edge formed by both the polarized lens and the non-polarized lens, and securing the polarized lens and the non-polarized lens together, the sealed lens unit being affixed in the frame such that the non-polarized lens constitutes an outer lens surface when positioned in the eyewear while in use in order to protect the polarized lens from water impact.

8. The eyewear as claimed in claim 5 wherein the sealed lens unit further comprises a non-polarized lens laminated with the laminated polarized lens, the water-impermeable sealing film covering and extending beyond a peripheral edge formed by both the polarized lens and the non-polarized lens in a water-tight manner, and the sealing film having a strength to secure the polarized lens and the non-polarized lens together, the sealed lens unit being affixed in the frame such that the non-polarized lens constitutes an outer lens surface when positioned in the eyewear while in use in order to protect the polarized lens from water impact.

9. Eyewear used for water sports comprising:

a pair of lens units, each lens unit including a laminated polarized lens and a seal member, the seal member covering and extending beyond a peripheral edge of the laminated polarized lens to prevent moisture from contacting the peripheral edge thereof;

a pair of frames, each frame receiving a corresponding one of the lens units affixed therein;

a bridge member interconnecting the frames at an inner side thereof; and means attached to an outer side of each frame for holding the eyewear against the face of a wearer thereof.

10. The eyewear as claimed in claim 9 wherein each of the lens units further comprises a non-polarized lens laminated with the polarized lens, the seal member covering and extending beyond a peripheral edge formed by both the laminated polarized lens and the non-polarized lens in a water-tight manner to prevent moisture from contacting the peripheral edge thereof and to secure the laminated polarized lens and non-polarized lens together, each of the lens units being affixed in the corresponding one of the frames such that the non-polarized lens constitutes an outer lens surface when positioned in the eyewear while in use in order to protect the polarized lens from water impact.

11. The eyewear as claimed in claim 10 wherein the seal member comprises an elastomeric ring in tension surrounding the peripheral edge formed by both the laminated polarized lens and the non-polarized lens.

* * * * *